US011905470B1

(12) United States Patent
Choi et al.

(10) Patent No.: US 11,905,470 B1
(45) Date of Patent: Feb. 20, 2024

(54) METHODS FOR REDUCING COKE FORMATION IN HEAVY OIL UPGRADING USING SUPERCRITICAL WATER

(71) Applicant: Saudi Arabian Oil Company, Dhahran (SA)

(72) Inventors: Ki-Hyouk R. Choi, Dhahran (SA); Joo-Hyeong R. Lee, Dhahran (SA); Abdullah Tariq AlAbdulhadi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/194,974

(22) Filed: Apr. 3, 2023

(51) Int. Cl.
*C10G 31/08* (2006.01)
*C10G 9/00* (2006.01)

(52) U.S. Cl.
CPC ..... *C10G 31/08* (2013.01); *C10G 9/005* (2013.01); *C10G 2300/1033* (2013.01); *C10G 2300/206* (2013.01); *C10G 2300/4081* (2013.01); *C10G 2300/708* (2013.01); *C10G 2300/805* (2013.01)

(58) Field of Classification Search
CPC ..... C10G 31/08; C10G 9/005; C10G 2300/1033; C10G 2300/206; C10G 2300/4081; C10G 2300/708; C10G 2300/805
See application file for complete search history.

(56) References Cited

U.S. PATENT DOCUMENTS

| | | | | |
|---|---|---|---|---|
| 9,505,678 | B2 | 11/2016 | Choi et al. | |
| 9,695,364 | B2 | 7/2017 | Iversen | |
| 10,011,790 | B2 | 7/2018 | Choi et al. | |
| 2011/0042273 | A1* | 2/2011 | Kaminsky | B01J 23/85 208/48 AA |

(Continued)

FOREIGN PATENT DOCUMENTS

CA 2774062 C 4/2011

OTHER PUBLICATIONS

Qu et al., "Dissolution of polycyclic aromatic hydrocarbons in subcritical and supercritical Water: A molecular dynamics simulation study", Chemical Engineering Science, vol. 195, pp. 958-967, 2019.

(Continued)

*Primary Examiner* — Randy Boyer
*Assistant Examiner* — Juan C Valencia
(74) *Attorney, Agent, or Firm* — DINSMORE & SHOHL LLP

(57) ABSTRACT

A process for reducing coke and coke precursor formation in supercritical water may include producing a supercritical water stream by heating and pressurizing a feed water, mixing the supercritical water stream with heated pressurized feed oil in a mixing device, to create a combined feed stream, feeding the combined feed stream into a supercritical water reactor to produce an upgraded product producing a cooled depressurized upgraded product, separating the cool depressurized product in a fractionator into a liquid hydro- (Continued)

carbon stream and a hydrocarbon vapor stream, condensing the hydrocarbon vapor stream with a cooling device to produce a light hydrocarbon water mixture and a separate gas product, recycling the light hydrocarbon mixture to mix with the feed water upstream of the supercritical reactor.

7 Claims, 3 Drawing Sheets

(56) References Cited

U.S. PATENT DOCUMENTS

| | | | | |
|---|---|---|---|---|
| 2015/0321975 | A1* | 11/2015 | Choi | C10G 33/00<br>585/400 |
| 2021/0395614 | A1 | 12/2021 | Choi et al. | |
| 2022/0315849 | A1* | 10/2022 | Pradeep | C10B 57/06 |

OTHER PUBLICATIONS

Wiehe, "A Phase-Separation Kinetic Model for Coke Formation" Ind. Eng. Chem. Res, vol. 32, pp. 2447-2454, 1993.

* cited by examiner

METHODS FOR REDUCING COKE FORMATION IN HEAVY OIL UPGRADING USING SUPERCRITICAL WATER

TECHNICAL FIELD

Embodiments of the present disclosure generally relate to supercritical water processes for heavy oil upgrading, and are particularly directed to preventing formation of coke and coke precursors in the upgrading process.

BACKGROUND

Traditionally, upgrading of heavy oil has been conducted by hydrogen addition and carbon rejection ways. In hydrogen addition, heavy oil is delivered to one or more catalytic reactors in the presence of external supply of hydrogen to be cracked, isomerized, alkylated, hydrogenated, desulfurized, denitrogenated, deoxygenated, and demetallized. In general, the product from the hydrogen addition route is ready to be sold as a fuel or another suitable oil product that can be used by customers. However, the hydrogen addition route requires high capital and operating costs. In most refineries, the large consumption of hydrogen requires additional hydrogen production plants other than a catalytic reforming unit where aromatization of paraffinic naphtha occurs to produce aromatics and hydrogen. Moreover, processes that operate under the hydrogen addition route category have stricter limitations for feedstocks. For example, certain fixed bed hydrodesulfurization process cannot accept highly asphaltenic feedstock due to the short catalyst lifetime and the sudden pressure build-up in the reactor In contrast, carbon rejection route processes, such as conventional coking, desirably do not need a catalyst supply and hydrogen supply, although the products from this route often struggle to meet market specifications. Supercritical water is a carbon rejection route that captures the advantages coupled with foregoing an external hydrogen supply, including decreased complexity and lower operating cost, while minimizing the disadvantages of the carbon rejection route. Using supercritical water allows for uniform heat transfer to the hydrocarbons in the crude oil during thermal cracking. Supercritical water also decreases coke formation and improves liquid product yield by diluting the hydrocarbons in the crude oil and forming cages of supercritical water molecules around the hydrocarbons to suppress inter-radical reactions. Surrounding of radical species by supercritical water, also known as the cage effect, enables better product yield than conventional coking process.

In spite of the various benefits of supercritical water, the process has technical challenges to be resolved, such as high energy requirements, and high equipment costs. Moreover, due to the limited availability of hydrogen and harsh reaction conditions, the supercritical water upgrading process may undesirably form reactor plugging materials such as solid coke.

Within the crude oil, light hydrocarbons and maltene fractions have a higher solubility in supercritical water (ScW), and thus dissolve quickly in supercritical water after being contacted. At the same time, heavy hydrocarbons and asphaltene fractions do not dissolve readily and thus remain in the oil phase. Polyaromatic hydrocarbons, such as asphaltene, which is a precursor of solid coke, can be converted to solid coke when exposed to high temperatures, for example, supercritical water temperatures, or temperatures above 400° C. This production of coke undesirably increases plugging and thus is a detriment to the supercritical water upgrading process. Accordingly, there is a need for improved supercritical water processes and systems that reduce coke formation.

SUMMARY

Embodiments of the present disclosure meet this need of reducing coke formation by enhancing dissolution and dispersion of polyaromatic hydrocarbons such as asphaltene in supercritical water in order to reduce coke formation. Specifically, the present embodiments produce light hydrocarbon product to enhance dissolution of polyaromatic hydrocarbons, such as asphaltene, and thereby suppress coke formation without sacrificing process performance. Moreover, the present disclosure recycles light product, which is comprised of light hydrocarbons and water. Referring to FIG. 1, maltene and asphaltene have different coking profiles. Maltene, which is highly soluble in supercritical water, needs a longer time to form coke than asphaltene. The time required to form coke is called an induction period. When asphaltene is mixed with maltene, the induction period of asphaltene is lengthened. Thus, delaying the separation of asphaltene and maltene into separate phases for the maximum time possible may limit the exposure time of asphaltene to high temperatures, and thereby limit coke formation. Without being limited by theory, by recycling the light hydrocarbon and water mixture for re-use in the ScW reactor, it was surprisingly found that these recycled liquid hydrocarbons delay phase separation of asphaltene and maltene and thereby lengthen the induction period for forming coke. This enables increased residence time within the ScW and thus improved upgrading performance i.e., increased conversion and desulfurization.

According to one or more of the present disclosure, a process for reducing coke or coke precursor in supercritical water is provided. The process may comprise producing a supercritical water stream by heating and pressurizing a feed water. The process may further comprise mixing the supercritical water stream with pressurized, heated feed oil in a mixing device to create a combined feed stream. The process may further comprise feeding the combined stream into a supercritical water (ScW) reactor to produce an upgraded product, where the supercritical water reactor operates at a temperature greater than a critical temperature of water and a pressure greater than a critical pressure of water. The process may further comprise producing a cooled depressurized upgraded product by cooling and depressurizing the upgraded product, separating the cooled depressurized upgraded product in a fractionator into a liquid hydrocarbon stream and a hydrocarbon vapor stream, condensing the hydrocarbon vapor stream with a cooling device to produce a light hydrocarbon water mixture and a separate gas product, and recycling the light hydrocarbon water mixture to mix with the feed water upstream of the supercritical water reactor.

BRIEF DESCRIPTION OF THE DRAWINGS

The following detailed description of the specified embodiments of the present disclosure can be best understood when read in conjunction with the following drawings in which.

DETAILED DESCRIPTION

Definitions

Figure 1:
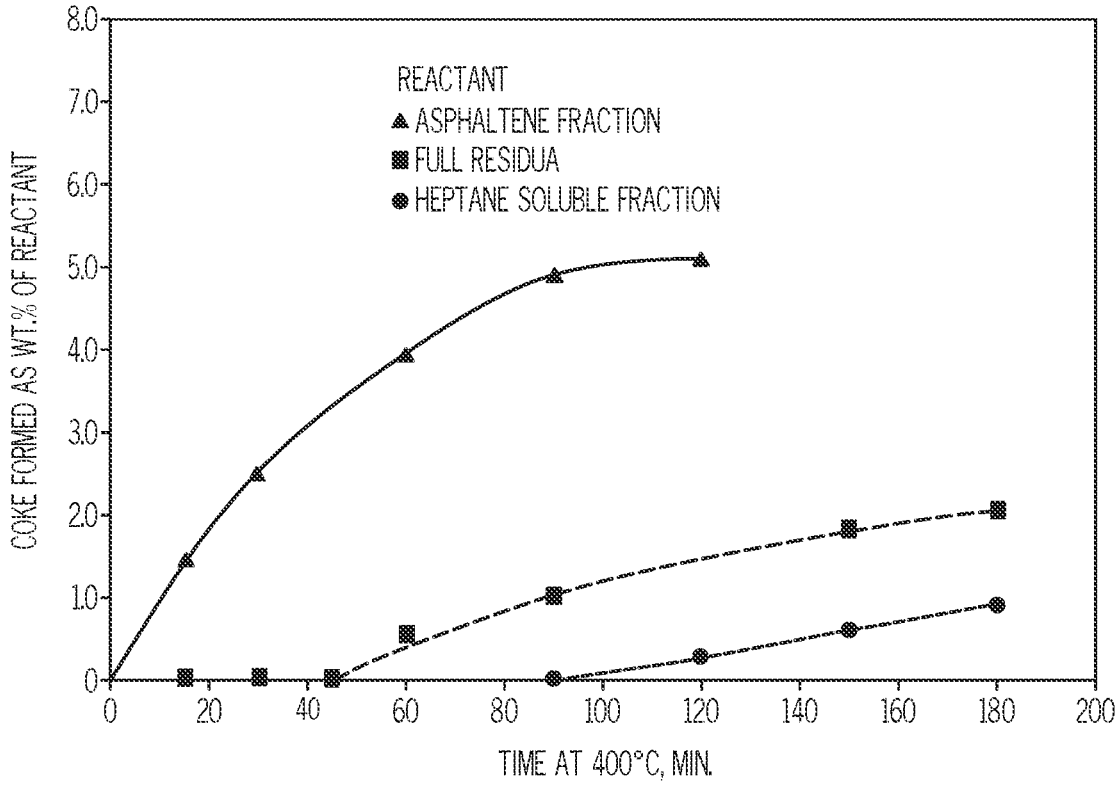
FIG. 1 is a graphical view of coke formation at high temperatures of asphaltene compared to asphaltene and co-presence of maltene (heptane soluble fraction).

As used throughout this disclosure, "crude oil" refers to whole range crude oil, distilled crude oil, residue oil, topped crude oil, product streams from oil refineries, product streams from steam cracking processes, liquefied coals, liquid products recovered from oil or tar sands, bitumen, oil shale, asphaltene, biomass hydrocarbons, liquid product from Gas-to-Liquid (GTL) process, liquid product from chemical recycling of waste plastic/municipal waste, and other similar petroleum-based oils.

As used in this disclosure, "effluent" refers to a stream that is passed out of a reactor, a reaction zone, or a separation unit following a particular reaction or separation. Generally, an effluent has a different composition than the stream that entered the separation unit, reactor, or reaction zone. It should be understood that when an effluent is passed to another system unit, only a portion of that system stream may be passed. For example, a slip stream may carry some of the effluent away, meaning that only a portion of the effluent may enter the downstream system unit.

As used throughout this disclosure, "heavy fraction" refers to the portion of the crude oil that comprises chemical compounds with boiling points equal to or above 650° F., when measured by true boiling point (TBP). As a non-limiting example, a crude oil possesses 10% heavy fraction by weight when, by weight, 10% of the chemical compounds within the crude oil have boiling points equal to or above 650° F., when measured by true boiling point.

As used throughout this disclosure, "supercritical water" or "SCW" refers to water that is at a temperature above the critical temperature of water and a pressure above the critical pressure of water.

As used herein, "maltene" is a maltene fraction, which is soluble in alkanes such as n-heptane and n-pentane.

As used herein, "asphaltene" is an asphalt fraction, which is insoluble in alkanes such as n-heptane and n-pentane.

As used herein, a "reactor" refers to a vessel in which one or more chemical reactions may occur between one or more reactants optionally in the presence of one or more catalysts. For example, a reactor may include a tank or tubular reactor configured to operate as a batch reactor, a continuous stirred-tank reactor (CSTR), or a plug flow reactor. Exemplary reactors include packed bed reactors such as fixed-bed reactors, and fluidized bed reactors. One or more "reaction zones" may be disposed in a reactor. As used herein, a "reaction zone" refers to a volume where a particular reaction takes place in a reactor. For example, a packed bed reactor with multiple catalyst beds may have multiple reaction zones, where each reaction zone is defined by the volume of each catalyst bed.

As used herein, "residence time," refers to the amount of time taken for a feed stream to enter and then exit the treatment units, reactors, and separators discussed herein.

As used herein, a "separation unit" or "separator" refers to any separation device that at least partially separates one or more chemicals that are mixed in a process stream from one another. For example, a separation unit may selectively separate differing chemical species, phases, or sized material from one another, forming one or more chemical fractions. Examples of separation units include, without limitation, distillation columns, distillation towers, flash drums, knock-out drums, knock-out pots, centrifuges, cyclones, filtration devices, traps, scrubbers, expansion devices, membranes, solvent extraction devices, and the like. It should be understood that separation processes described in this disclosure may not completely separate all of one chemical constituent from all of another chemical constituent. It should be understood that the separation processes described in this disclosure "at least partially" separate different chemical components from one another, and that even if not explicitly stated, it should be understood that separation may include only partial separation. As used herein, one or more chemical constituents may be "separated" from a process stream to form a new process stream. Generally, a process stream may enter a separation unit and be divided, or separated, into two or more process streams of desired composition. Further, in some separation processes, a "lower boiling point fraction" (sometimes referred to as a "light fraction" or "light fraction stream") and a "higher boiling point fraction" (sometimes referred to as a "heavy fraction," "heavy hydrocarbon fraction," or "heavy hydrocarbon fraction stream") may exit the separation unit, where, on average, the contents of the lower boiling point fraction stream have a lower boiling point than the higher boiling point fraction stream. Other streams may fall between the lower boiling point fraction and the higher boiling point fraction, such as a "medium boiling point fraction."

Figure 2:
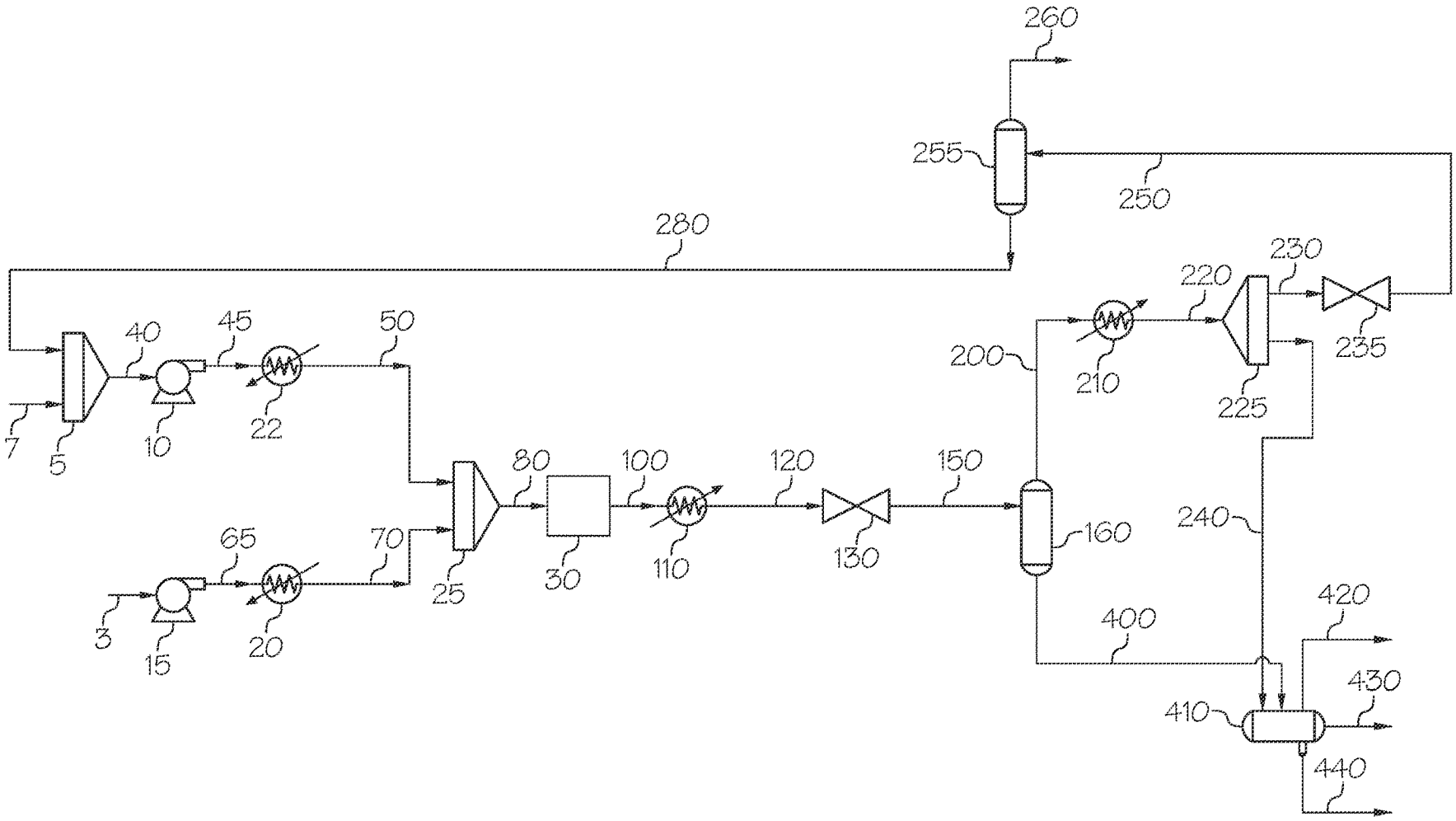
FIG. 2 is a schematic view of a method of reducing coke formation in heavy oil upgrading using supercritical water, according to one or embodiments of the present disclosure.

Referring to FIG. 2, systems and methods to suppress coke formation in heavy oil upgrading using supercritical water are shown. The method comprises producing a supercritical water stream 50 by heating and pressurizing a feed water 7. As shown, the feed water 7 is fed to a mixer 5, for example, a mixer tee that combines the feed water 7 and the recycle feed 280 as detailed further below into a combined feed water 40.

The feed water 7 may comprise demineralized water, which may have a conductivity of less than 1 microsiemens (μS)/centimeters (cm), preferably, less than 0.5 μS/cm, more preferably, 0.1 μS/cm. The feed water may comprise a sodium content of less than 5 ug/l, preferably 1 ug/l; chloride content of less than 5 ug/l, preferably 1 ug/l; and a silica content of less than 3 ug/l. The recycle feed 280 and the combined feed 40 may have the same or similar compositions.

Various temperatures are considered suitable for the feed water 7. For example, it can be ambient temperature or greater. Additionally, various pressures are contemplated for the feed water 7. In one or more embodiments, the pressure of the feed water 7 may be from 1 to 100 psig, or from 1 to 20 psig. The recycle feed 280 and the combined feed 40 may have the same or similar processing conditions.

The combined feed water 40 may then be pressurized using a pressurization device 10 such as a compressor to produce a pressurized feed water 45. The pressurized feed water 45 may have a pressure of at least 3,200 psig, from 3,200 to 5,200 psig, from 3,200 to 4,200 psig, or from 3,500 to 4,500 psig.

Next, the pressurized feed water 45 is heated in a heating device 22, such as a heat exchanger 22 to achieve the supercritical water 50. The supercritical water 50 may have a pressure of at least 3,200 psig, from 3,200 to 5,200 psig, from 3,200 to 4,200 psig, or from 3,500 to 4,500 psig. The supercritical water 50 may have a temperature of at least 374° C., from 374 to 600° C., or from 400 to 500° C.

Referring again to FIG. 2, the supercritical water stream 50 is mixed with pressurized, heated feed oil 70 in a mixing device 25 to create a combined feed stream 80.

The feed oil 3 may comprise any hydrocarbon derived from petroleum, coal, coal liquid, biomass, plastics, whole range crude oil, distilled crude oil, residue oil, topped crude oil, product streams from oil refineries, product streams from steam cracking processes, liquefied coals, liquid products recovered from oil or tar sands, bitumen, oil shale, asphaltene, biomass hydrocarbons, liquid hydrocarbons from pyrolysis of plastics. The feed oil may have boiling points higher than 200° C., or greater than 316° C. In specific embodiments, the feed oil may include greater than 4 wt. % sulfur, at least 2500 ppm Nitrogen, and at least 15 wt. % Conradson Carbon Content.

Various temperatures are considered suitable for the feed oil 3. For example, it can be at ambient temperature or greater. In specific embodiments, the feed oil 3 may have a temperature of 25 to 300° C., from 50 to 250° C., or from 100 to 200° C. Additionally, various pressures are contemplated for the feed oil 3. In one or more embodiments, the pressure of the feed oil 3 may be from 1 to 100 psig, or from 1 to 20 psig.

The feed oil 3 may then be pressurized using a pressurization device 15 such as a compressor to produce a pressurized feed oil 65. The pressurized feed oil 65 may have a pressure of at least 3,200 psig, from 3,200 to 5,200 psig, from 3,200 to 4,200 psig, or from 3,500 to 4,500 psig.

Next, the pressurized feed oil 65 may be heated in a heating device 20 to achieve the pressurized, heated feed oil 70. The heating device 22 may be selected from an electric heater, gas fired heater, fuel oil fired heater, heat exchanger or a combination thereof. The pressurized, heated feed oil 70 may have a pressure of at least 3,200 psig, from 3,200 to 5,200 psig, from 3,200 to 4,200 psig, or from 3,500 to 4,500 psig. The pressurized, heated feed oil 70 may have a temperature of at least 100° C., from 100 to 300° C., from 100 to 250° C., or from 150 to 200° C.

Referring again to FIG. 2, the supercritical water stream 50 is mixed with the pressurized, heated feed oil 70 in a mixing device 25 to create a combined feed stream 80. The mixing device 25 may be selected from: static mixer, inline mixer, impeller-embedded mixer, CSTR-type mixer, and combinations thereof. While the present embodiments describe supercritical water stream 50 is mixed with the pressurized, heated feed oil 70 in a mixing device 25 upstream of the supercritical water reactor 30, other options, for example, mixing the supercritical water stream 50 and the pressurized, heated feed oil 70 in the supercritical water reactor 30 are contemplated.

The combined feed stream 80 may have a pressure of at least 3,200 psig, from 3,200 to 5,200 psig, from 3,200 to 4,200 psig, or from 3,500 to 4,500 psig. The combined feed stream 80 may have a temperature of a temperature of at least 374° C., from 374 to 500° C., or from 374 to 425° C.

As shown in FIG. 2, the combined feed stream 80 is fed into the supercritical water (ScW) reactor 30 to produce an upgraded product 100. In some embodiments, the mixed stream may be preheated by a heater (not shown) before being subjected to the ScW reactor. The ScW reactor is selected from tubular type, vessel-type, CSTR-type, or combinations thereof. The preferred reactor type is a tubular type. The ScW reactor may have external or internal heaters to control the fluid temperature to preset level. The heater may be selected from electric heater, fired heater, and heat exchanger.

The residence time in the reactor may be between 0.1-120 minutes, or 1-60 minutes. Residence time is calculated by assuming internal fluid to be 100% water (for density calculation).

The upgraded product 100 may then be cooled using a cooling device 110, such as a heat exchanger, to produce a cooled upgraded product 120. The cooled upgraded product 120 may have a temperature of less than 374° C., from 100 to 350° C., from 200 to 300° C., or from 225 to 275° C.

The cooled upgraded product 120 may then be depressurized using a depressurization device 130, such as a valve, to produce a cooled, depressurized upgraded product 150. The cooled, depressurized upgraded product 150 may have a temperature of less than 374° C., from 100 to 350° C., from 150 to 300° C., or from 150 to 200° C. The cooled, depressurized upgraded product 150 may have a pressure less than 3,200 psig, from 10 to 650 psig, or from 150 to 300 psig.

Referring again to FIG. 2, the cooled, depressurized upgraded product 150 may then be separated in a fractionator 160 into a liquid hydrocarbon stream 400 and a hydrocarbon vapor stream 200. The fractionator 160 may comprise various suitable devices, for example, a flash drum. The flash drum may have internal structures such as a mesh pad, diffusers, valves, or other components familiar to one of ordinary skill in the art. The flash drum can have external or internal heater or cooler to control the temperature of internal fluid to achieve superheating or supercooling.

The liquid hydrocarbon stream 400 and a hydrocarbon vapor stream 200 may each have a pressure less than 3,200 psig, from 10 to 650 psig, or from 150 to 300 psig. Moreover, the liquid hydrocarbon stream 400 and the hydrocarbon vapor stream 200 may each have a temperature of less than 374° C., from 100 to 350° C., or from 150 to 300° C.

In one or more embodiments, the hydrocarbon vapor stream from the fractionator 160 may be sent to a cooling device 210, such as a condenser, to produce a light hydrocarbon-water mixture 280 and a separate gas product 260. The light hydrocarbon water mixture 280 may then be recycled to mix with the feed water 7 upstream of the supercritical water reactor 30. The gaseous product 260 may comprise one or more of $H_2$, CO, $CO_2$, $H_2S$, $NH_3$, $H_2O$, and $C_1$-$C_5$.

The light hydrocarbon water mixture 280 may be predominantly water, or 95%-99.5 wt. % water. Moreover, the light hydrocarbon water mixture 280 may comprise 0.5 to 5 wt. % hydrocarbons. The hydrocarbons of the light hydrocarbon water mixture 280 comprises paraffins, olefins, napthenes, and aromatics. In embodiments, the hydrocarbons may comprise from 30 to 60 wt. %, from 30 to 45 wt. %, or from 30 to 40 wt. % paraffins based on the weight of the hydrocarbons. In embodiments, the hydrocarbons may comprise from 10 to 70 wt. %, from 20 to 60 wt. % olefins, or from 40 to 50 wt. % olefins based on the weight of the hydrocarbons. Moreover, the hydrocarbons may comprise from 0 to 10 wt. %, from 2 to 8 wt. %, from 4 to 6 wt. % napthenes based on the weight of the hydrocarbons. Furthermore, the hydrocarbons may comprise from 5 to wt. %, from 5 to 40 wt. %, 10 to 30 wt. %, or from 15 to 25 wt. % aromatics based on the weight of the hydrocarbons. Without being limited to theory, aromatics aid in the dispersion and dissolution of heavy hydrocarbons and asphaltenes in supercritical water.

In embodiments, the majority of the hydrocarbons may be $C_2$-$C_8$ hydrocarbons. Without being limited to theory, the 90% distillation temperature (T90) of hydrocarbons in the light hydrocarbon water mixture 280 is lower than 450° C., or lower than 380° C. to ensure immediate dissolution of hydrocarbons in the supercritical water. Moreover, the light hydrocarbon water mixture 280 is substantially free of inorganic impurities and suitable to use as a feed water. As used herein, substantially free means less than 0.1, less than 0.01, or less than 0.001 wt. % impurities.

In embodiments, the volumetric ratio of feed water 7 to feed oil 3 in the ScW reactor may have a range from $1/0.1$ to $1/10$, or from $1/0.1$ to $1/2$ at standard ambient temperature and pressure (SATP). Moreover, the ratio of light hydrocarbon water mixture 280 (i.e., recycle) to feed water 7 may have a range from $1/0.5$ to $1/20$, or from $1/2$ to $1/5$ at SATP. Without being limited by theory, the mixture of feed water 7 and light hydrocarbon water mixture 280 should include more fresh feed water than recycle water; however, the recycled water should be present in sufficient quantity to have the "solvent" effect of the hydrocarbons in the recycled water.

Referring again to FIG. 2, the liquid stream 400 may be subjected to a gas-water-oil 410, which yields gas phase product 420, oil phase product 430, and water product 440.

In alternative embodiments as shown in FIG. 2, prior to being fed to the splitting device 225, the hydrocarbon vapor stream 200 may be cooled by a cooling device 210 and then split into two streams 230 and 240 by a splitter 225. One split stream 240 may also be delivered to the gas-water-oil separator 410 for further processing.

EXAMPLES

The various embodiments of processes and systems for the reducing coke formation will be further clarified by the following examples. The examples are illustrative in nature, and should not be understood to limit the subject matter of the present disclosure.

Illustrative Example

The Illustrative Example, which is depicted in FIG. 2, was performed using Aspen HYSYS simulation software. The ScW reactor 30 was a tubular-type having internal diameter of 25.84 inch and length of 180.428 ft. The reactor was vertical (30 ft. upflow, then 30 ft. downflow.). The residence time of fluid in the reactor was 1.5 minutes. The stream process conditions of the Illustrative Example are in Table 1 and the feed and oil product hydrocarbon properties are in Table 2. The composition of the recycle stream (liquid hydrocarbon water mixture 280) are provided in Table 3.

TABLE 1

Stream properties of Illustrative Example

| Stream | | Feed Water 7 | 40 | Pressurized Feed Water 45 | Supercritical Water (ScW) 50 |
|---|---|---|---|---|---|
| Temperature | C. | 25 | 49 | 50 | 480 |
| Pressure | psig | 14 | 14 | 3901 | 3901 |
| Mass Flow | kg/h | 35700 | 67498 | 67498 | 67498 |
| Liquid Volume Flow | Barrel/day | 5400 | 10219 | | |

| Stream | | Feed Oil 3 | Pressurized Feed Oil 65 | Pressurized Heated Feed Oil 70 | Combined ScW and Feed Oil 80 |
|---|---|---|---|---|---|
| Temperature | C. | 150 | 150 | 180 | 402 |
| Pressure | psig | 14 | 3901 | 3901 | 3901 |
| Mass Flow | kg/h | 40514 | 40514 | 40514 | 108013 |
| Liquid Volume Flow | Barrel/day | 6000 | | | |

| Stream | | ScW Reactor Effluent 100 | Cooled ScW Effluent 120 | Cooled Depressurized ScW Effluent 150 | Vapor Stream 200 | Liquid Stream 400 |
|---|---|---|---|---|---|---|
| Temperature | C. | 446 | 250 | 198 | 201 | 201 |
| Pressure | psig | 3901 | 3901 | 224 | 22 | 224 |
| Mass Flow | kg/h | 108013 | 108013 | 108013 | 34183 | 73830 |
| Liquid Volume Flow | Barrel/day | | | | | |

| Stream | | Cooled Vapor Stream 220 | 230 | 240 | 250 | Gas Phase 260 |
|---|---|---|---|---|---|---|
| Temperature | C. | 80 | 80 | 80 | 75 | 75 |
| Pressure | psig | 224 | 224 | 224 | 14 | 14 |
| Mass Flow | kg/h | 34183 | 34183 | 0 | 34183 | 2385 |
| Liquid Volume Flow | Barrel/day | | | | | |

TABLE 1-continued

| Stream properties of Illustrative Example | | | | | |
|---|---|---|---|---|---|
| Stream | | Recycled Water 280 | Gas Phase Product 420 | Oil Phase Product 430 | Water Phase Product 440 |
| Temperature | C. | 75 | 60 | 60 | 60 |
| Stream | | Feed Water 7 | 40 | Pressurized Feed Water 45 | Supercritical Water (ScW) 50 |
| Pressure | psig | 14 | 224 | 224 | 224 |
| Mass Flow | kg/h | 31798 | 0 | 39290 | 34540 |
| Liquid Volume Flow | Barrel/day | 4819 | | 6166 | 5225 |

TABLE 2

| Feed oil and product hydrocarbon properties of illustrative example | | | |
|---|---|---|---|
| | Feed Oil | Oil Phase Product 430 | Hydrocarbons in Recycle Stream 280 |
| Specific Gravity(API) | 7.2 | 15.5 | 31.5 |
| Distillation(TBP, oC) | | | |
| 5% | 483 | 339 | 237 |
| 10% | 509 | 374 | 245 |
| 30% | 551 | 441 | 263 |
| 50% | 633 | 496 | 288 |
| 70% | 735 | 552 | 317 |
| 90% | 913 | 635 | 371 |
| 95% | 1029 | 668 | 395 |
| Sulfur content(wt % sulfur) | 4.91% | 2.9% | 1.2% |
| Nitrogen content(wt ppm nitrogen) | 3110 | 928 | 63 |
| Conradson Carbon Content (wt %) | 17.9 | 5.9 | ND |

TABLE 3

| Liquid Hydrocarbon Water Mixture Components | |
|---|---|
| Component | Wt. % |
| Water | 98.85 wt. % |
| Hydrocarbons | 1.15 wt. % |
| Amounts of Hydrocarbon Component Based on overall weight of Hydrocarbons | |
| Paraffins | 30 wt. % |
| Olefins | 45 wt. % |
| Naphthenes | 5 wt. % |
| Aromatics | 20 wt .% |

Comparative Example

Figure 3:
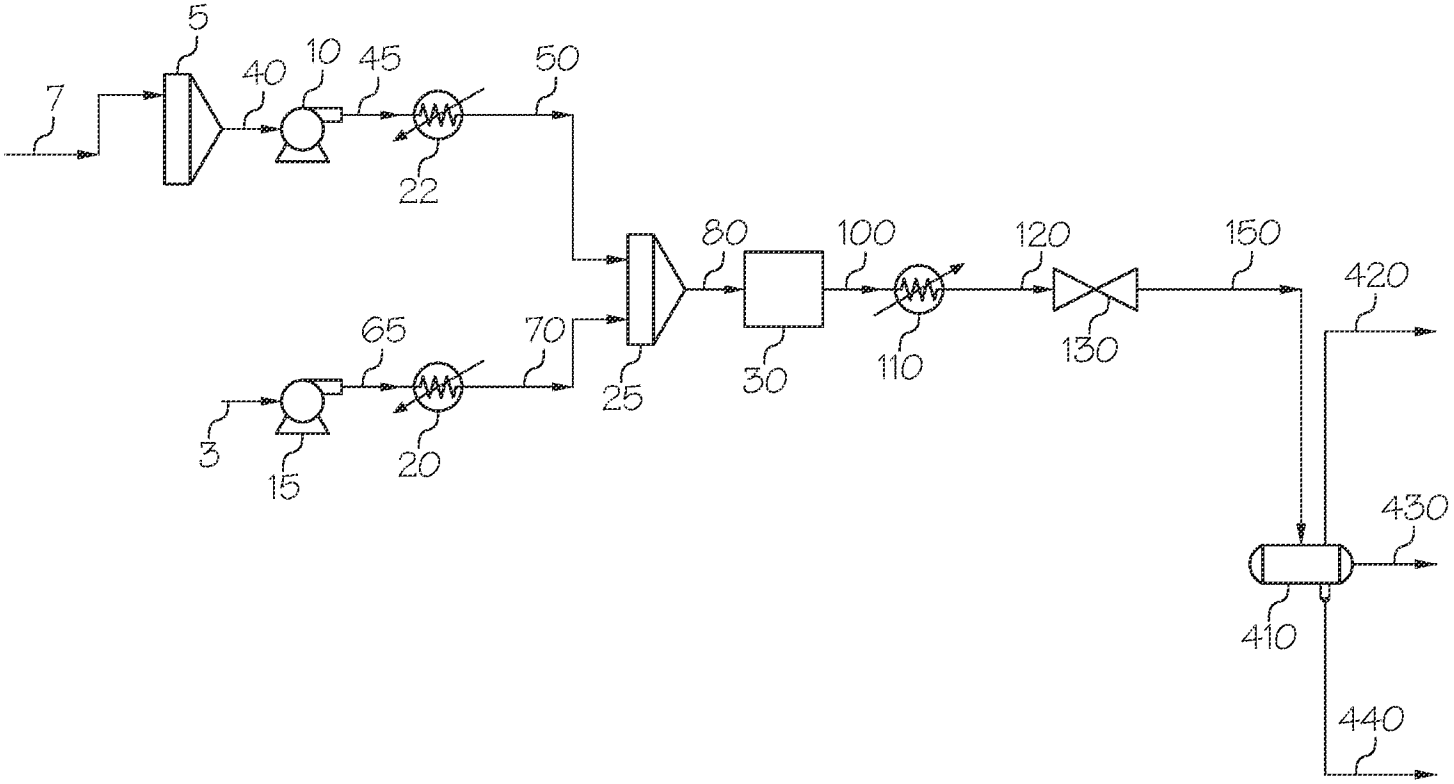
FIG. 3 (PRIOR ART)
FIG. 3 is a schematic view of a conventional supercritical water upgrading process.

The same feedstock was introduced to the comparative process of FIG. 3; however, as shown, this process did not include the recycling stream. Operating conditions of the comparative process are provided in Table 4, and the feed oil and product hydrocarbon properties are in Table 5. The ScW reactor sizing was the same.

TABLE 4

| Operating conditions of Comparative Example | | | | | |
|---|---|---|---|---|---|
| Stream | | Feed Water 7 | 40 | Pressurized Feed Water 45 | Supercritical Water (ScW) 50 |
| Temperature | C. | 25 | 25 | 25 | 480 |
| Pressure | Psig | 14 | 14 | 3901 | 3901 |
| Mass Flow | kg/h | 67498 | 67498 | 67498 | 67498 |
| Liquid Volume Flow | barrel/day | 10210 | 10210 | | |
| Stream | | Feed Oil 3 | Pressurized Feed Oil 65 | Pressurized Heated Feed Oil 70 | Combined ScW and Feed Oil 80 |
| Temperature | C. | 150 | 151 | 180 | 410 |
| Pressure | Psig | 0 | 3901 | 3901 | 3901 |
| Mass Flow | kg/h | 40514 | 40514 | 40514 | 108012 |
| Liquid Volume Flow | barrel/day | 6000 | | | |

TABLE 4-continued

| Operating conditions of Comparative Example | | | | |
|---|---|---|---|---|
| Stream | | ScW Reactor Effluent 100 | Cooled ScW Effluent 120 | Cooled Depressurized ScW Effluent 150 |
| Temperature | C. | 446 | 250 | 199 |
| Pressure | psig | 3901 | 3901 | 224 |
| Mass Flow | kg/h | 108012 | 108012 | 108012 |
| Liquid Volume Flow | barrel/day | | | |
| Stream | | Gas Phase Product 420 | Oil Phase Product 430 | Water Phase Product 440 |
| Temperature | C. | 60 | 60 | 60 |
| Pressure | psig | 224 | 224 | 224 |
| Mass Flow | kg/h | 1513 | 39704 | 66795 |
| Liquid Volume Flow | barrel/day | | 6287 | 10111 |

TABLE 5

| Feed oil and product hydrocarbon properties of Comparative Example | | |
|---|---|---|
| | Feed Oil | Oil Phase Product 430 |
| Specific Gravity(API) | 7.2 | 14.7 |
| Distillation(TBP, ° C.) | | |
| 5% | 483 | 358 |
| 10% | 509 | 426 |
| 30% | 551 | 521 |
| 50% | 633 | 599 |
| 70% | 735 | 654 |
| 90% | 913 | 707 |
| 95% | 1029 | 926 |
| Sulfur content (wt % sulfur) | 4.91% | 3.9% |
| Nitrogen content (wt ppm nitrogen) | 3110 | 1587 |
| Conradson Carbon Content (wt %) | 17.9 | 9.6 |

For the comparative case, the residence time was about 2.7 minutes, which was less than half of the 5.7 minutes residence time of the Illustrative Example. By recycling the hydrocarbons, the Illustrative Example was able to be operated at longer residence time without facing plugging by coke formation. Due to coking risk, the comparative example required a minimized residence time. In contrast, the longer residence time of the Illustrative Example yielded much greater desulfurization, specifically obtaining a final yield of 1.2 wt. %, whereas the Comparative Example achieved a final yield of 3.9 wt. %. Moreover, the Illustrative Example also achieved a much greater reduction in Nitrogen and Conradson Carbon Content compared to the Comparative Example.

The present application discloses several technical aspects. The first aspect is directed at a process for reducing coke and coke precursor formation in supercritical water. The process may comprise producing a supercritical water stream by pressurizing and heating a feed water and mixing the supercritical water stream with pressurized heated feed oil in a mixing device to create a combined feed stream. The process may also comprise feeding the combined feed stream into a supercritical (ScW) reactor to produce an upgraded product where the supercritical water reactor operates at a temperature greater than a critical temperature of water and a pressure greater than a critical pressure of water. The process may also comprise producing a cooled depressurized upgraded product by cooling and depressurizing the upgraded product, separating the cooled, depressurized upgraded product in a fractionator into a liquid hydrocarbon stream and a hydrocarbon vapor stream, condensing the hydrocarbon vapor stream with a cooling device to produce a light hydrocarbon water mixture and a separate gas product, and recycling the light hydrocarbon water mixture to mix with the feed water upstream of the supercritical water reactor.

The second aspect of the present disclosure may include the first aspect where the liquid hydrocarbon stream from the fractionator is passed to a gas-water-oil separator.

The third aspect of the present disclosure may include any of the previous aspects where the fractionator comprises a flash drum.

The fourth aspect of the present disclosure may include any of the previous aspects where the light hydrocarbon water mixture comprises 95%-99.5 wt. % water and 0.5 to 5 wt. % hydrocarbons.

The fifth aspect of the present disclosure may include any of the previous aspects where the light hydrocarbon water mixture comprises from 30 to 60 wt. % paraffins, from 10 to 70 wt. % olefins, from 0 to 10 wt. % napthenes, and from 5 to 60 wt. % aromatics based on the weight of the hydrocarbons.

The sixth aspect of the present disclosure may include any of the previous aspects where the feed oil further comprises whole range crude oil, distilled crude oil, residue oil, topped crude oil, product streams from oil refineries, product streams from cracking processes, liquefied coals, liquid products recovered from oil or tar sands, bitumen, oil shale, asphaltene, biomass hydrocarbons, liquid hydrocarbons from pyrolysis of plastics, or combinations thereof.

The seventh aspect of the present disclosure may include any of the previous aspects where the feed water comprises demineralized water, the demineralized water possessing a conductivity of less than 1 microsiemens/centimeters, a sodium content of less than 5 micrograms/liter, a chloride content of less than 5 micrograms/liter, and a silica content of less than 3 micrograms/liter.

It is noted that recitations in the present disclosure of a component of the present disclosure being "operable" or "sufficient" in a particular way, to embody a particular property, or to function in a particular manner, are structural recitations, as opposed to recitations of intended use. More specifically, the references in the present disclosure to the manner in which a component is "operable" or "sufficient" denotes an existing physical condition of the component and, as such, is to be taken as a definite recitation of the structural characteristics of the component.

It is also noted that terms like "preferably," "commonly," and "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present disclosure or to emphasize alternative or additional features that may or may not be utilized in a particular embodiment of the present disclosure.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

Having described the subject matter of the present disclosure in detail and by reference to specific embodiments, it is noted that the various details disclosed in the present disclosure should not be taken to imply that these details relate to elements that are essential components of the various embodiments described in the present disclosure. Further, it will be apparent that modifications and variations are possible without departing from the scope of the present disclosure, including, but not limited to, embodiments defined in the appended claims.

The singular forms "a", "an" and "the" include plural referents, unless the context clearly dictates otherwise.

Throughout this disclosure ranges are provided. It is envisioned that each discrete value encompassed by the ranges are also included. Additionally, the ranges which may be formed by each discrete value encompassed by the explicitly disclosed ranges are equally envisioned.

As used herein and in the appended claims, the words "comprise," "has," and "include" and all grammatical variations thereof are each intended to have an open, non-limiting meaning that does not exclude additional elements or steps.

As used herein, terms such as "first" and "second" are arbitrarily assigned and are merely intended to differentiate between two or more instances or components. It is to be understood that the words "first" and "second" serve no other purpose and are not part of the name or description of the component, nor do they necessarily define a relative location, position, or order of the component. Furthermore, it is to be understood that the mere use of the term "first" and "second" does not require that there be any "third" component, although that possibility is contemplated under the scope of the present disclosure.

The invention claimed is:

1. A process for reducing coke or coke precursor formation in supercritical water comprising:

producing a supercritical water stream by heating and pressurizing a feed water;

mixing the supercritical water stream with pressurized, heated feed oil in a mixing device to create a combined feed stream;

feeding the combined feed stream into a supercritical water (ScW) reactor to produce an upgraded product, where the supercritical water reactor operates at a temperature greater than a critical temperature of water and a pressure greater than a critical pressure of water;

producing a cooled, depressurized upgraded product by cooling and depressurizing the upgraded product;

separating the cooled, depressurized upgraded product in a fractionator into a liquid hydrocarbon stream and a hydrocarbon vapor stream;

condensing the hydrocarbon vapor stream with a cooling device to produce a light hydrocarbon water mixture and a separate gas product; and recycling the light hydrocarbon water mixture to mix with the feed water upstream of the supercritical water reactor.

2. The process of claim 1, wherein the liquid hydrocarbon stream from the fractionator is passed to a gas-water-oil separator.

3. The process of claim 1, wherein the fractionator comprises a flash drum.

4. The process of claim 1, wherein the light hydrocarbon water mixture comprises 95%-99.5 wt. % water and 0.5 to 5 wt. % hydrocarbons.

5. The process of claim 1, wherein the hydrocarbons of the light hydrocarbon water mixture comprises from 30 to 60 wt. % paraffins, from 10 to 70 wt. % olefins, from 0 to 10 wt. % napthenes, and from 5 to 60 wt. % aromatics based on the weight of the hydrocarbons.

6. The process of claim 1 wherein the feed oil further comprises whole range crude oil, distilled crude oil, residue oil, topped crude oil, product streams from oil refineries, product streams from cracking processes, liquefied coals, liquid products recovered from oil or tar sands, bitumen, oil shale, asphaltene, biomass hydrocarbons, liquid hydrocarbons from pyrolysis of plastics, or combinations thereof.

7. The process of claim 1 wherein the feed water comprises demineralized water, the demineralized water possessing a conductivity of less than 1 microsiemens/centimeters, a sodium content of less than 5 micrograms/liter, a chloride content of less than 5 micrograms/liter, and a silica content of less than 3 micrograms/liter.

* * * * *